US010509365B2

(12) United States Patent
Mertenat

(10) Patent No.: US 10,509,365 B2
(45) Date of Patent: Dec. 17, 2019

(54) ANALOGUE DISPLAY HAND

(71) Applicant: ETA SA Manufacture Horlogere Suisse, Grenchen (CH)

(72) Inventor: Olivier Mertenat, Grenchen (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 16/020,418

(22) Filed: Jun. 27, 2018

(65) Prior Publication Data

US 2018/0307184 A1 Oct. 25, 2018

Related U.S. Application Data

(62) Division of application No. 15/603,876, filed on May 24, 2017, now Pat. No. 10,331,079.

(30) Foreign Application Priority Data

May 26, 2016 (EP) ..... 16171513

(51) Int. Cl.
*G04B 19/04* (2006.01)

(52) U.S. Cl.
CPC ..... *G04B 19/044* (2013.01); *G04B 19/042* (2013.01)

(58) Field of Classification Search
CPC ..... B22D 17/14; B22D 17/007; C22C 45/00; G04B 19/04; G04B 19/042; G04B 19/044
See application file for complete search history.

(56) References Cited

U.S. PATENT DOCUMENTS

| | | | | |
|---|---|---|---|---|
| 6,453,512 | B1 * | 9/2002 | Kaelin | G04B 3/041 16/441 |
| 9,329,572 | B2 * | 5/2016 | Helfer | G04B 19/042 |
| 2005/0078561 | A1 | 4/2005 | Endo et al. | |
| 2009/0286064 | A1 | 11/2009 | Endo et al. | |
| 2010/0243603 | A1 | 9/2010 | Fiaccabrino et al. | |
| 2011/0086976 | A1 | 4/2011 | Endo et al. | |
| 2013/0163391 | A1 * | 6/2013 | Helfer | B22D 17/007 368/101 |
| 2013/0279307 | A1 | 10/2013 | Fiaccabrino et al. | |
| 2014/0064046 | A1 | 3/2014 | Amano | |
| 2016/0179057 | A1 * | 6/2016 | Stranczl | G04B 19/042 368/285 |

FOREIGN PATENT DOCUMENTS

| | | |
|---|---|---|
| EP | 1 449 888 A1 | 8/2004 |
| EP | 2 060 534 A1 | 5/2009 |
| EP | 2 400 353 A1 | 12/2011 |

OTHER PUBLICATIONS

European Search Report dated Oct. 25, 2016 in European Application 16171513.1, filed on May 26, 2016 (with English Translation of Categories of cited documents).

* cited by examiner

*Primary Examiner* — Sean P Kayes
(74) *Attorney, Agent, or Firm* — Oblon, McClelland, Maier & Neustadt, L.L.P.

(57) ABSTRACT

A display hand intended to equip a timepiece, including a body and a pipe, providing an arbor hole arranged for fitting the display hand onto a drive arbor. The body is made of a composite material, the pipe includes, over all or part of the outer periphery, a surface for connection to the hand body to ensure the adhesion of the composite material to the pipe.

8 Claims, 2 Drawing Sheets

ANALOGUE DISPLAY HAND

This application is a divisional of U.S. patent application Ser. No. 15/603,876, filed May 24, 2017, which claims priority from EP No. 16171513.1 filed on May 26, 2016, the entire disclosure of which is hereby incorporated herein by reference.

FIELD OF THE INVENTION

The invention relates to the field of horology and particularly the field of analogue display members, such as timepiece hands.

The invention also concerns a timepiece and a method for fabricating a display hand.

BACKGROUND OF THE INVENTION

The fabrication of a hand intended to be used as a display member in a timepiece is particularly complex, especially when it concerns a hand intended to equip a high-end timepiece, in which the hand must have an immaculate surface, possibly provided with facets.

Usually, the hands are fabricated from brass, steel, gold, aluminium, or a special alloy. They may be galvanized, covered with paint, oxidized, or untreated when the material used is gold. They are generally produced by machining or by stamping.

One drawback of these display hands is that the materials used have a high density, which implies a high moment of inertia and a high unbalanced force which respectively result in the hand floating and the hand slipping, in the event of a shock.

Moreover, the machining and stamping techniques involve high mechanical stresses, which requires operations of adjusting the shape of the hand to obtain a relatively flat hand.

Yet another drawback is that current hand fabrication techniques cannot produce all the desired forms.

SUMMARY OF THE INVENTION

It is an object of the invention to overcome the various drawbacks of these known techniques.

More specifically, it is an object of the invention to provide a display hand having a reduced weight, and in any desired form.

It is also an object of the invention, at least in a particular embodiment, to provide a display hand that is simple and inexpensive to implement.

These objects, in addition to others which will appear more clearly below, are achieved according to the invention with a display hand intended to equip a timepiece, comprising a body and a pipe, in which is provided an arbor hole arranged for fitting the display hand onto a drive arbor.

According to the invention, the body is made of a composite material, the pipe comprises, over all or part of the outer periphery, a surface for connection to the hand body to ensure the adhesion of the composite material to the pipe.

Thus, the subject of the present invention, through the various functional and structural aspects described above, makes it possible to obtain a display hand able to accommodate different sizes and/or different forms with no concern as to the weight of the hand.

In accordance with other advantageous variants of the invention:

- the pipe includes a first portion of a diameter D1, and a second portion of a diameter D2 which is greater than D1,
- the second portion includes the surface for connection to the hand body;
- the connecting surface is textured;
- the hand body covers the second portion of the pipe;
- the pipe is made of a metallic material, such as brass or copper-beryllium;
- the body is made of injection moulded carbon fibre reinforced plastic or of injection moulded carbon fibre reinforced thermoplastic;
- the upper surface of the body includes patterns in relief or facets;
- the upper surface of the body includes a treatment.

The invention also concerns a timepiece fitted with at least one display hand according to the invention.

The invention also concerns a method for fabricating display hands intended to equip timepieces, each display hand comprising a body and a pipe, in which is provided an arbor hole arranged for fitting the display member onto a drive arbor, wherein the method comprises the following steps:

- placing the pipes inside a mould;
- injecting the composite material to form a sheet of composite material moulded onto the pipes;
- micro-machining the sheet to form the body of at least one hand.

In accordance with other advantageous variants of the method of the invention:

- the micro-machining step is implemented to simultaneously produce several display hands in the same sheet;
- the micro-machining step consists of laser cutting, water jet cutting or CNC milling;
- the method comprises at least one step of depositing a coating on at least one face of the body of each display hand;
- the method comprises at least one step of micro-machining the upper face of the body to form therein patterns in relief or facets.

BRIEF DESCRIPTION OF THE DRAWINGS

Other characteristics and advantages of the invention will appear more clearly upon reading the following description of a specific embodiment of the invention, given simply by way of illustrative and non-limiting example, and the annexed Figures, among which.

DETAILED DESCRIPTION OF PREFERRED EMBODIMENTS

Figure 1:
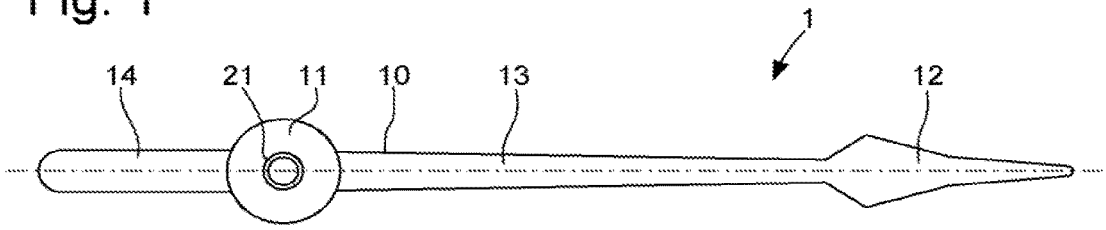
FIG. 1 is a top view of a display hand according to the invention.

A display hand according to the invention will now be described below referring jointly to FIGS. 1 to 4.

Display hand 1 is intended to equip a timepiece; the hand comprises a body 10 and a pipe 20, in which is provided an arbor hole 21 arranged for fitting the display hand 1 onto a drive arbor.

According to the represented embodiment, body 10 includes a circular head 11 inside which is housed pipe 20 to allow assembly of hand 1 on the drive arbor of the watch. Arbor hole 21 of pipe 20 is arranged to be fitted onto a drive arbor, by means, for example, of a press fit operation.

Pipe 20 exerts a clamping force on the drive arbor which makes it possible to retain hand 1 axially on the drive arbor and to link these two elements in rotation.

Body 10 also includes a tip 12 which forms the indicator section of hand 1, and is linked to head 11 by an elongated part 13. Tip 12 has the form of a triangle here but could take any other form suitable for indicating a determined angular position on a timepiece dial.

Body 10 of hand 1 may also include a counterweight 14, of rectangular shape and linked to head 12 in the extension of elongated part 13. Likewise, counterweight 14 may take any other form, for example it is possible to envisage the counterweight taking the form of a logo.

According to the invention, body 10 is made of a composite material, such as carbon fibre reinforced plastic, carbon fibre reinforced thermoplastic, or carbon fibre reinforced polymer. Such materials are very light and resistant, and make it possible to reduce the moment of inertia of the hand and to obtain the desired hand forms and sizes.

The pipe takes the form of a cylinder here in which is provided an arbor hole 21, arranged for fitting display hand 1 onto a drive arbor. Pipe 20 may be made of a metallic material such as brass, copper-beryllium, aluminium or gold, since these materials can easily be deformed when the pipe is pressed onto its arbor. Indeed, pipe 20 is generally forced onto an arbor having a slightly greater diameter than the diameter of the arbor hole; the elastic and plastic properties of the metallic materials employed make it possible to press pipe 20 onto the rotating arbor without damaging hand body 10 made of composite material.

According to the invention, pipe 20 comprises over all or part of the outer periphery, a surface 24 for connection to body 10 of the hand to ensure the adhesion of the composite material to pipe 20. It is possible to envisage connecting surface 24 extending over the entire outer periphery of pipe 20, or being geometrically arranged at certain angular positions.

As can be observed in FIG. 1, the pipe comprises a first portion 22 of a diameter D1 arranged to be pressed onto an arbor, and a second portion 23 of diameter D2, which is greater than D1, arranged to receive and hold hand body 10. A pipe having the same diameter over its entire height could also be used.

According to the invention, connecting surface 24 may extend over all or part of the height of second portion 23. For example, connecting surface 23 may occupy the entire height of the second portion of pipe 20 or only half the height.

Figure 3:
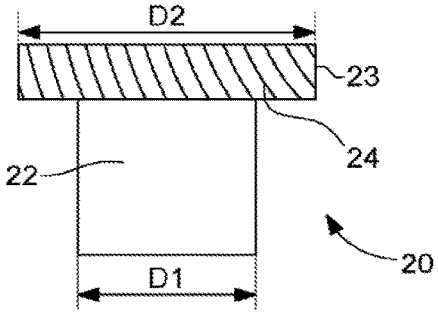
FIG. 3 is a plan view of a pipe of a display hand according to the invention.

According to a first embodiment of the invention, connecting surface 24 may be textured to ensure better adhesion of hand body 10 to pipe 20. For example, and as illustrated in FIG. 3, knurling may be performed on second portion 23 of the pipe so that the composite material penetrates the knurled ridges.

Figure 2A:
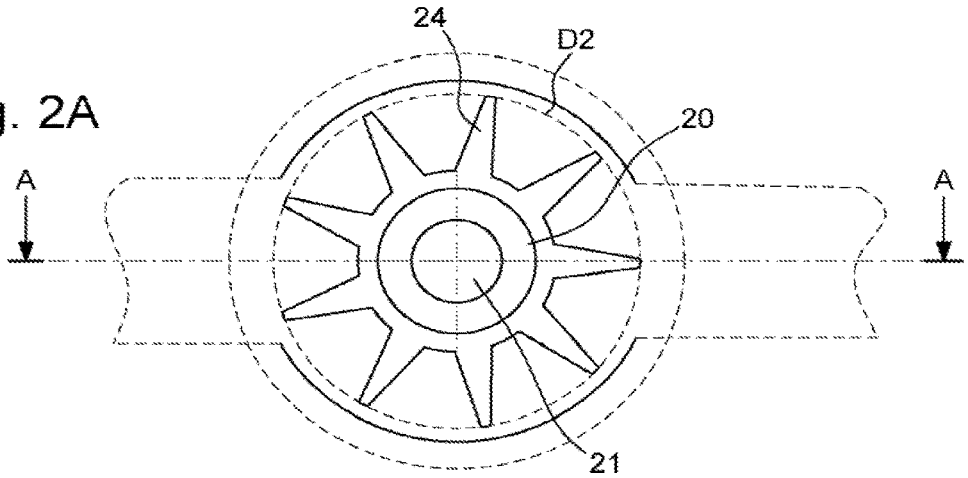
FIGS. 2*a* and 2*b* are respectively a top view and a cross-sectional view along line AA of a display hand according to the invention.
Figure 2B:
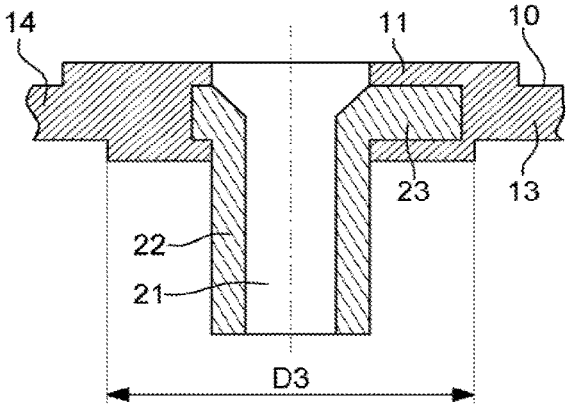

According to another embodiment of the invention, seen in FIGS. 2*a* and 2*b*, connecting surface 24 may take the form of a pinion or of a toothed wheel, in which case the composite material is inserted between the teeth and ensures a good hold of body 10 on pipe 20.

Connecting surface 24 can thus ensure a good radial connection between pipe 20 and body 11.

As can be observed in FIGS. 1 and 2*b*, body 10 of hand 1 may cover second portion 24 of pipe 20. The hand has an overmoulded portion of diameter D3 underneath second portion 23, in order to provide a good axial hold, since diameter D3 is smaller than diameter D2 of second portion 23 of pipe 20.

According to one embodiment of the invention, the upper surface of body 10 of hand 1 may comprise patterns in relief or facets to decorate the hand.

According to yet another embodiment of the invention, the upper surface of body 10 of hand 1 may receive a coating, for example a metallic coating. This coating may be deposited by chemical vapour deposition or physical vapour deposition techniques.

FIGS. 4 to 7 represent several steps of the method for fabricating display hands 1 according to the teaching of the invention.

The invention also concerns a method for fabricating display hands 1 intended to equip timepieces, each display hand comprising a body 10 and a pipe 20, in which is provided an arbor hole 21, arranged for fitting the display hand onto a drive arbor. The method includes the following steps:

- placing pipes 20 inside a mould;
- injecting the composite material to form a sheet 30 of composite material moulded onto pipes 20, the pipes becoming integral with sheet 30 owing to the connecting surfaces of the pipes;
- micro-machining sheet 30 to form the body of at least one hand 1.

Figure 4:
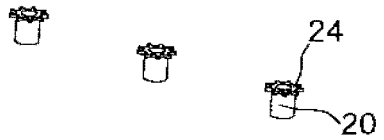
FIG. 4 is a diagram of a method for fabricating a display hand according to the invention.

FIG. 4 represents a series of pipes 20 prior to implementation of the method of the invention, i.e. prior to being placed inside the mould.

Figure 5:
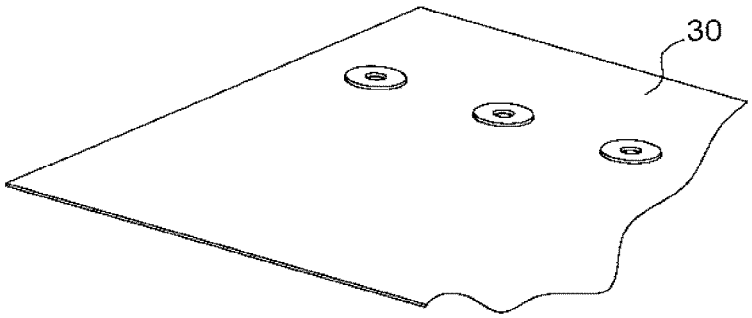
FIG. 5 illustrates the step of injecting composite material into a mould containing pipes, to form a composite material sheet on the pipes.

FIG. 5 illustrates the step of injecting the composite material into the mould containing pipes 20, to form a composite material sheet 30 on pipes 20.

Figure 6:
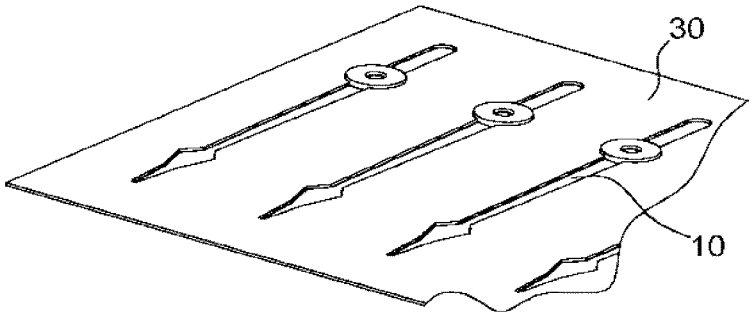
FIG. 6 illustrates the composite material sheet wherein hands are micromachined in the sheet.
Figure 7:
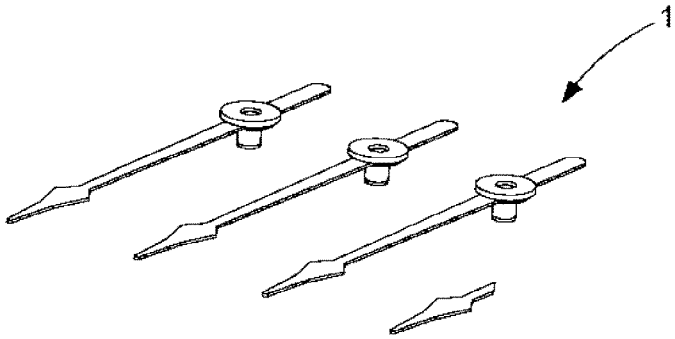
FIG. 7 illustrates the hands released from the composite material sheet.

FIG. 6 illustrates the composite material sheet 30 wherein hands 1 are micromachined in sheet 30. The micromachining may be achieved by means of laser cutting, water jet or plasma cutting, or by means of CNC milling.

The final step in the fabrication of hands 1 consists in releasing hands 1 from composite material sheet 30.

Advantageously, a series of several hands 1 is simultaneously produced in the same composite material sheet 30.

The method according to the invention may include at least one step during which a coating, for example a metallic coating, is deposited on composite material sheet 30. This coating may be deposited by chemical vapour deposition or physical vapour deposition techniques.

Such a step can be implemented when composite material sheet 30 has been moulded onto the pipes.

According to the invention, the method comprises at least one step of micro-machining the upper face of the body to form form therein patterns in relief or facets. These may be geometric or other patterns, which makes it possible to obtain interesting optical effects. Such geometric patterns may, for example, give the surface of the hands a guilloche effect.

Such a step can be implemented when hands 1 are still carried by composite material sheet 30.

It is also possible to imagine a specific mould for forming facets on composite material sheet 30 when the latter is injected onto pipes 20.

It is noted that the method for fabrication of hands 1 according to the invention makes it easy to produce hands 1 of very varied form and outward appearance.

Advantageously, the method according to the invention can be implemented at the same time on several composite material sheets 30, to simultaneously produce hands with similar features in several composite material sheets.

As a result of the different aspects of the invention, there is obtained a display hand having a lower specific weight than the materials used to date, which makes it possible to reduce the moment of inertia and unbalanced force of the hand. The invention also makes it possible to obtain any desired form of hand.

The above description corresponds to a preferred embodiment and should in no way be considered limiting, more particularly as regards the form described for the various structural elements comprised in the hand, or their materials. Those skilled in the art will not encounter any particular difficulty in choosing, for example for the hand body, any other material having the mechanical properties required to implement the present invention.

There are a large number of possible applications for such a hand, since the present invention can be implemented for any type of portable devices having a hand, notably hand-held or worn on the wrist.

NOMENCLATURE

1. Hand,
10. Body,
11. Head,
12. Tip,
13. Elongated part,
14. Counterweight,
20. Pipe,
21. Arbor hole,
22. First pipe portion,
23. Second pipe portion,
24. Connecting surface,
30. Composite material sheet,
D1. Diameter of the first portion,
D2. Diameter of the second portion,
D3. Diameter of the lower part.

The invention claimed is:

1. A method for fabricating display hands intended to equip timepieces, each display hand comprising a body and a pipe, providing an arbor hole arranged for fitting the display hand onto a drive arbor, wherein the method comprises the following steps:

placing at least one pipe inside a mould, the at least one pipe comprising a first portion of a diameter D1, and a second portion of a diameter D2 which is greater than D1;

after the placing, injecting composite material to form a sheet of composite material moulded on said at least one pipe, the sheet including a top side, a bottom side, and a through hole extending from the top side to the bottom side;

after the injecting, micro-machining the sheet to form the body of at least one hand; and releasing the at least one hand from the sheet, wherein, after the releasing is complete, the first portion of the pipe is positioned below a bottom side of the through hole and the second portion of the pipe is positioned within the sheet when the second portion is below a top side of the through hole and above the bottom side of the through hole, the diameter D2 of the second portion of the pipe positioned within the sheet being greater than a diameter of the through hole at the top side of the sheet and greater than a diameter of the through hole at the bottom side of the sheet such that said at least one pipe is integral with the sheet.

2. The fabrication method according to claim 1, wherein the micro-machining step is implemented to simultaneously produce several display hands in a same composite material sheet.

3. The fabrication method according to claim 1, wherein the micro-machining step consists of laser cutting, water jet cutting or CNC milling.

4. The fabrication method according to claim 1, comprising at least one step of depositing a coating on at least one face of the body of each display hand.

5. The fabrication method according to claim 1, wherein the method comprises at least one step of micro-machining an upper face of the body to form therein patterns in relief or facets.

6. The fabrication method according to claim 1, wherein the body includes a head, a counterweight extending from a first side of the head, and an elongated part extending from a second side of the head that is opposite to the first side.

7. The fabrication method according to claim 6, wherein the through hole is located in the head of the body.

8. The fabrication method according to claim 1, wherein the at least one pipe does not protrude out of the through hole at the top side of the sheet.

* * * * *